US008851039B2

(12) United States Patent
Flender et al.

(10) Patent No.: US 8,851,039 B2
(45) Date of Patent: Oct. 7, 2014

(54) ADJUSTABLE CAMSHAFT

(71) Applicant: Mahle International GmbH, Stuttgart (DE)

(72) Inventors: Thomas Flender, Eberdingen (DE); Michael Kreisig, Stuttgart (DE); Juergen Rommel, Burgstetten (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 13/779,245

(22) Filed: Feb. 27, 2013

(65) Prior Publication Data

US 2013/0220069 A1 Aug. 29, 2013

(30) Foreign Application Priority Data

Feb. 29, 2012 (DE) ..... 102012203145.6

(51) Int. Cl.
*F01L 1/14* (2006.01)
*F01L 1/047* (2006.01)
*F01L 1/344* (2006.01)

(52) U.S. Cl.
CPC ..... *F01L 1/34413* (2013.01); *F01L 1/047* (2013.01); *F01L 2001/0473* (2013.01)
USPC ..... 123/90.6; 123/90.16; 123/90.18

(58) Field of Classification Search
USPC ..... 123/90.16, 90.6, 90.18
See application file for complete search history.

(56) References Cited

U.S. PATENT DOCUMENTS

| | | | | |
|---|---|---|---|---|
| 4,484,751 | A * | 11/1984 | Deuring | 277/574 |
| 6,691,656 | B1 | 2/2004 | Pierik et al. | |
| 7,610,890 | B2 | 11/2009 | Lettmann et al. | |
| 7,802,549 | B2 | 9/2010 | Schneider | |
| 2009/0152966 | A1 | 6/2009 | Bock et al. | |
| 2009/0229551 | A1 | 9/2009 | Clever et al. | |
| 2011/0114046 | A1 | 5/2011 | Flender et al. | |
| 2012/0145101 | A1 | 6/2012 | Yoshika et al. | |

FOREIGN PATENT DOCUMENTS

| | | | |
|---|---|---|---|
| DE | 102005014680 | A1 | 8/2006 |
| DE | 102005038656 | A1 | 8/2006 |
| DE | 102005062207 | A1 | 6/2007 |
| DE | 102009049217 | A1 | 4/2011 |
| EP | 2048385 | A1 | 4/2009 |
| JP | 2009-144522 | A | 7/2009 |
| WO | WO-2011/065326 | A1 | 6/2011 |

OTHER PUBLICATIONS

English abstract for JP-2009-144522.
European Search Report for EP13154654.1 dated Jul. 17, 2013.
German Search Report for DE-102012203145.6.
English abstract for DE-102005038656.

* cited by examiner

*Primary Examiner* — Zelalem Eshete
(74) *Attorney, Agent, or Firm* — Rader, Fishman & Grauer PLLC

(57) ABSTRACT

An adjustable camshaft may include an inner shaft and an outer shaft coaxially surrounding the inner shaft. A cam may have a cam body and a ring collar axially projecting from the cam body. The ring collar may be slidingly arranged with a radial gap on the outer shaft and have a receptacle for pinning together the cam and the inner shaft with a pin. A seal may be arranged in a region of the ring collar for sealing the gap.

20 Claims, 1 Drawing Sheet

ADJUSTABLE CAMSHAFT

CROSS-REFERENCE TO RELATED APPLICATION

This application claims priority to German Patent Application 10 2012 203 145.6, filed on Feb. 29, 2012, which is hereby incorporated by reference in its entirety.

TECHNICAL FIELD

The present invention relates to an adjustable camshaft with an inner shaft and an outer shaft coaxially surrounding said inner shaft, and with a cam pinned together with the inner shaft, according to the preamble of the claim 1.

BACKGROUND

A generic cam shaft is known from DE 10 2005 038 656 A1. Here, the camshaft has an inner shaft and an outer shaft arranged concentrically to and surrounding said inner shaft. Moreover, the camshaft has multiple cams which have in each case two cams connected to each other through a ring collar. For adjusting such a multiple cam, the multiple cam is provided in the region of the ring collar with a receptacle for pinning it together with the inner shaft. Here, a tight tolerance is provided between the respective cam body and the outer shaft which, on the one hand, ensures the sliding of the respective cam body along the outer shaft and, on the other, prevents the lubricating fluid, in particular an engine oil of the associated internal combustion engine, from escaping through the receptacle and between the respective cam body and the outer shaft. Moreover, in the region of the receptacle, a ring groove can be provided in the ring collar, which ring groove prevents in particular the formation of a burr in this region caused in particular by forming or fabricating the receptacle, in particular by drilling a bore.

It is desirable to provide such a multiple cam with only one cam body so as to achieve a higher variability of the adjustable camshaft. This configuration with only one adjustable cam body is an embodiment variant for special valve train designs—concept—based for OHC engines—e.g., in the case of a DOHC (two camshafts next to each other; one for the exhaust valves and the other one for the intake valves, or mixed). The construction having a ring collar is advantageous here because a bolt fixing the cam is spaced apart from the actual cam body, as a result of which, e.g., the risk of deformation caused by a bore or a pressed-in bolt can be reduced. Thus, such a cam has only one cam body and the ring collar. The disadvantage is that the cam, in particular on the ring collar side facing away from the cam body, may promote a leakage which can result in the escape of the pressurized lubricating fluid.

SUMMARY

The present invention is concerned with the problem of proposing for a camshaft of the generic kind an improved or at least alternative embodiment which is in particular characterized by reduced leakage.

This problem is solved according to the invention by the subject matter of the independent claim. Advantageous embodiments are subject matter of the dependent claims.

The present invention is based on the general idea of providing a camshaft with a seal in the region of a ring collar of a cam so as to create therewith a sufficient or at least improved fluidic isolation and, accordingly, to prevent or at least reduce a leakage in this region. The camshaft according to the invention has an inner shaft and an outer shaft which are arranged concentrically. The outer shaft is formed as a hollow shaft while the inner shaft can be configured, for example, as a solid shaft. Radially between the inner shaft and the outer shaft, a gap is formed or shaped in which pressurized lubricating fluid, in particular an engine oil of the associated internal combustion engine, is introduced so as to facilitate in particular the sliding of the cam along the outer shaft. Here, the cam comprising the cam body and the ring collar axially spaced apart from the cam body and connected to the cam body is slidingly arranged with a radial gap on the outer shaft. Moreover, the cam has a receptacle which is preferably formed in the ring collar and serves for pinning together the cam and the inner shaft. For this, an associated pin can be arranged on one side in the receptacle of the cam and on the other side in an associated inner shaft receptacle of the inner shaft. Advantageously, the outer shaft has a ring-shaped opening or ring opening through which the pin is guided. Accordingly, the pressurized lubricating fluid can get through the ring opening of the outer shaft and through the receptacle of the cam radially between the cam and the outer shaft so as to improve in particular the sliding properties of the cam on the outer shaft and to reduce friction between the cam and the outer shaft. According to the invention, the cam is provided in the region of the ring collar with a seal so as to prevent or at least reduce leakage of said lubricating fluid in the associated region. Here, the knowledge is used that such a leakage is created in particular in that the cam has such a cam body only on one axial side, which cam body is advantageously formed or arranged with a tight tolerance with respect to the outer shaft. This "non-uniform" formation of the cam results in that the lubricating fluid can escape on that side of the cam on which the cam body is not arranged, thus in the region of the ring collar. Thus, according to the invention, this leakage is counteracted in that the camshaft has a seal in the region of the ring collar.

Such a sealing can be achieved in particular by a suitable geometrical configuration or physical formation of the ring collar. It is advantageous here to configure a sealing length of the ring collar and a radial height of the gap between the ring collar and the outer shaft in an extreme ratio. Preferably, the ratio between the axial sealing length of the ring collar and the radial height of the gap is at least 50:1. In particularly preferred embodiments, this ratio between the axial sealing length of the ring collar and the radial height of the gap is 250:1. The axial sealing length of the ring collar extends here along the axial direction of the shafts, while the radial height of the gap is that extension of the gap between the outer shaft and the ring collar that extends along the radial direction of the shafts. Here, the axial sealing length of the ring collar is substantially given between the receptacle and an axial side face of the ring collar, said side face facing away from the cam body.

On its inner side facing toward the outer shaft, the ring collar has an inwardly open ring groove which surrounds in particular the receptacle. The ring groove serves in particular for the purpose of preventing burr formation on the cam, in particular on the ring collar, during the fabrication of the receptacle, which is usually carried out by means of drilling a bore. This ring groove can cause an additional or increased escape of lubricating fluid through the receptacle. If the ring collar has such a ring groove, the axial sealing length extends advantageously between a lateral edge of the ring groove, which lateral edge faces toward the side face of the ring collar, and the side face of the ring collar.

Alternatively or additionally, for implementing the seal, a sealing element can be provided which is arranged radially between the ring collar and the outer shaft. The seal thus has such a sealing element which can be arranged particularly in the ring groove of the ring collar. Also, the ring collar can have a seal groove in which said sealing element is arranged. Alternatively or additionally, the outer shaft can have a second seal groove in which the sealing element is arranged.

The sealing element is configured, for example, as an O-ring, as an X-ring or as a piston seal. Furthermore, the sealing element can be made from plastic, preferably from an elastomer, wherein the sealing element is advantageously formed such and is in particular made from such materials that it is suitable for the thermal and mechanical loads that can occur in this region of the camshaft.

According to a further embodiment, the sealing element is vulcanized on the ring collar or on the outer shaft. Preferably, such a sealing element is vulcanized on the side face of the ring collar or on a corresponding region of the outer shaft. It is to be understood that the camshaft can also have a plurality of such sealing elements each of which can be formed identically or differently.

Advantageously, the cam body and the ring collar are connected to each other. Here, the cam body and the ring collar can be connected to each other in any way and can be, for example, welded, glued, soldered together and the like. However, the cam is preferably formed such that the cam body and the ring collar are one piece.

Further important features and advantages of the invention arise from the sub-claims, from the drawings, and from the associated description of the figures based on the drawings.

It is to be understood that the above-mentioned features and the features still to be explained hereinafter are not only usable in the respective mentioned combination but also in other combinations or alone without departing from the context of the present invention.

A preferred exemplary embodiment of the invention is illustrated in the drawing and is explained in more detail in the following description.

DETAILED DESCRIPTION

Figure 1:
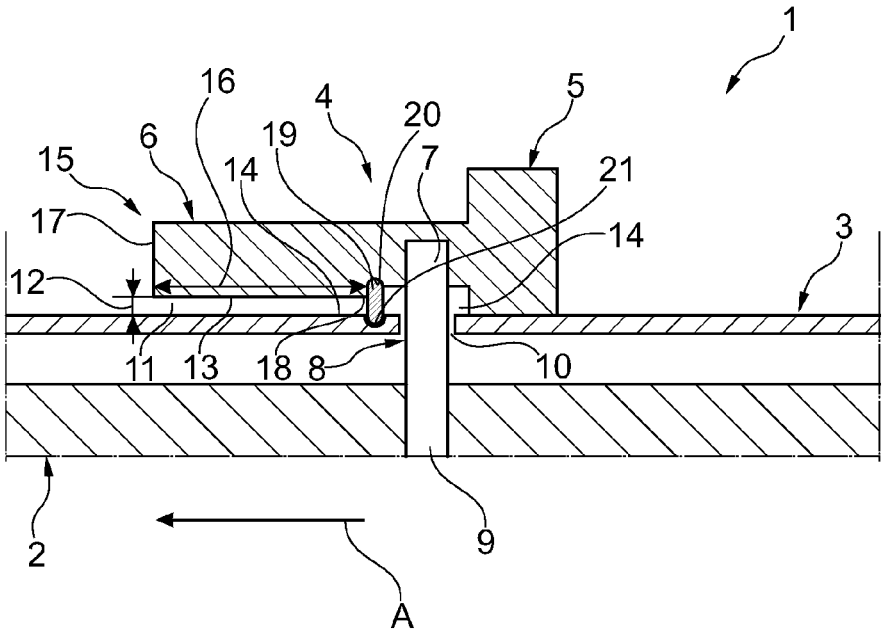
FIG. 1 shows a section through a camshaft according to the invention.
Figure 2:
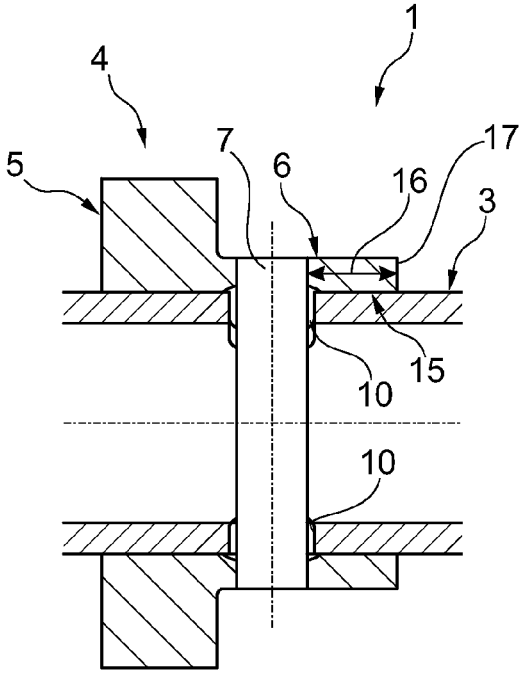
FIG. 2 and FIG. 3 show a section through a camshaft according to the invention, in each case in a different embodiment.
Figure 3:
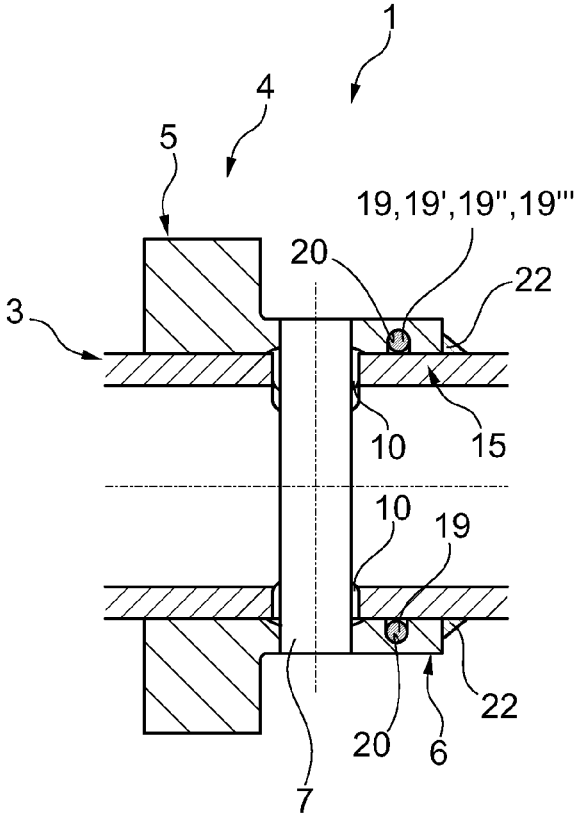

According to the FIGS. 1-3, an adjustable camshaft 1 has an inner shaft 2 and an outer shaft 3 arranged coaxially to and surrounding said inner shaft 2. The outer shaft 3 is configured here as a hollow shaft while the inner shaft 2 is configured as a solid shaft. Moreover, the adjustable camshaft 1 has a cam 4 which is slidingly arranged on the outer shaft 3, wherein the camshaft 1 may also have two or a plurality of cams 4. The section shown in FIG. 1 shows only a radial half of the adjustable camshaft 1 while the FIGS. 2 and 3 show both radial halves of the camshaft 1, wherein the inner shaft 2 is not shown in the FIGS. 2 and 3.

The cam 4 has a cam body 5 and a ring collar 6 which are formed in one piece. For an adjustable arrangement, the cam 4 has in the region of the ring collar 6 a recess 7 which serves for pinning together the cam 4 with the inner shaft 2. Accordingly, a pin 8 is arranged on one side in the recess 7 of the cam 4 and on the other side in an inner shaft recess 9 of the inner shaft 2. Moreover, the outer shaft 3 has a ring opening 10 through which the pin 8 extends. Furthermore, a gap 11 is arranged radially between the outer shaft 3 and the ring collar 6. The radial gap 11 has a radial height 12 which defines the radial spacing between an inner side 13 of the ring collar 6, which inner side faces toward the outer shaft 3, and outer contour 14 of the outer shaft 3, which outer contour faces toward the ring collar 6, and which radial height is illustrated excessively large in FIG. 1 for illustration reasons.

In the embodiment shown in FIG. 1, the ring collar 6 has in addition on its inner side 13 a ring groove 14 which is open radially inward and surrounds the receptacle 7 and which serves for the purpose of preventing the formation of a burr on the cam 4 when fabricating the receptacle 7, for example, by drilling a bore. According to the invention, the camshaft 1 has in the region of the ring collar 6 a seal 15 which prevents a lubricating fluid, in particular an engine oil of an associated internal combustion engine, which lubricating fluid is situated under pressure radially between the inner shaft 2 and the outer shaft 3, from flowing through the ring opening 10 and the gap 11. For this purpose, an axial sealing length 16 of the ring collar 6, which sealing length extends along the axial direction A, is at least 50 times greater than the radial height 12 of the gap 11. However, the sealing length 16 is preferably at least 250 times greater than the radial height 12 of the gap 13. Here, the axial sealing length 16 extends between a side face 17 of the ring collar 6, which side face faces away from the cam body 5, and a lateral edge 18 of the ring groove 14 of the ring collar 6, which lateral edge faces toward said side face 17.

Moreover, the seal 15 comprises a sealing element 19 which is arranged radially between the ring collar 6 and the outer shaft 3. The sealing element 19 is arranged in the ring groove 14 of the ring collar 6 or, respectively, in a first seal groove 20 which is formed on the inner side 13 of the ring collar 6 in the region of the ring groove 14. Moreover, the sealing element 19 is arranged in a second seal groove 21 which is formed on the outer contour 14 of the outer shaft 3.

In the embodiment shown in FIG. 2, the axial sealing length 16 of the ring collar 6 is at least 250 times the radial height 12 of the gap 11, wherein the gap 11 and the radial height 12 are not visible due the approximately true to scale illustration. Moreover, in the example shown in FIG. 2, the ring collar 6 has no ring groove 14 surrounding the receptacle 7 so that the axial sealing length 16 of the ring collar 6 extends between the side face 17 of the ring collar 6 and the receptacle 7.

The embodiment shown in FIG. 3 differs from the one shown in FIG. 2 to the effect that the seal 15 comprises in addition such a sealing element 19 which is arranged in the first seal groove 20 formed on the inner side 13 of the ring collar 6. The seal 15 further comprises an additional sealing element 22 which is vulcanized on the side face 17 of the ring collar 6.

The respective sealing elements 19, 22 can be, for example, an O-ring 19' or an X-ring 19", or a piston sealing ring 19'''.

The camshaft 1 according to the invention is in particular characterized in that a flow of the lubricating fluid through the gap 11 and thus a corresponding leakage is prevented or at least reduced.

The invention claimed is:

1. An adjustable camshaft, comprising: an inner shaft and an outer shaft coaxially surrounding the inner shaft, and at least one cam having a cam body and a ring collar axially projecting from the cam body, wherein the ring collar is slidingly arranged with a radial gap on the outer shaft and has a receptacle for pinning together the cam with the inner shaft by a pin, and a seal arranged in a region of the ring collar for sealing the gap;

wherein the radial gap has a radial height defined between an inner side of the ring collar and an outer contour of the outer shaft.

2. The camshaft according to claim 1, wherein an axial sealing length of the ring collar and a radial height of the gap have a ratio of at least 50:1.

3. The camshaft according to claim 1, wherein an axial sealing length of the ring collar and a radial height of the gap have a ratio of at least 250:1.

4. The camshaft according to claim 2, wherein the axial sealing length of the ring collar extends substantially between the receptacle and an axial side face of the ring collar, and wherein the axial side face faces away from the cam body.

5. The camshaft according to claim 2, wherein an inwardly open ring groove is arranged on an inner side of the ring collar, and wherein the axial sealing length extends between a lateral edge of the ring groove, and wherein the lateral edge faces toward an axial side face of the ring collar.

6. The camshaft according to claim 5, wherein the seal has a sealing element arranged radially between the ring collar and the outer shaft.

7. The camshaft according to claim 6, wherein the sealing element is at least one of an O-ring, an X-ring and a piston sealing ring, wherein the sealing element is made from plastic.

8. The camshaft according to claim 6, wherein the sealing element is vulcanized on at least one of the ring collar and on the outer shaft.

9. The camshaft according to claim 1, wherein the cam body and the ring collar are one piece.

10. The camshaft according to claim 6, wherein the sealing element is arranged in at least one of in the ring groove of the ring collar, in a first seal groove formed on the inner side of the ring collar, and on a second seal groove of the outer shaft open radially outwardly.

11. The camshaft according to claim 7, wherein the sealing element is vulcanized on at least one of the ring collar and on the outer shaft.

12. The camshaft according to claim 2, wherein an axial sealing length of the ring collar and a radial height of the gap have a ratio of at least 250:1.

13. The camshaft according to claim 12, wherein the axial sealing length of the ring collar extends substantially between the receptacle and an axial side face of the ring collar, and wherein the axial side face faces away from the cam body.

14. The camshaft according to claim 13, wherein an inwardly open ring groove is arranged on an inner side of the ring collar, and wherein the axial sealing length extends between a lateral edge of the ring groove, and wherein the lateral edge faces toward an axial side face of the ring collar.

15. The camshaft according to claim 14 wherein the cam body and the ring collar are one piece.

16. The camshaft according to claim 2 wherein the cam body and the ring collar are one piece.

17. The camshaft according to claim 3 wherein the cam body and the ring collar are one piece.

18. The camshaft according to claim 4 wherein the cam body and the ring collar are one piece.

19. The camshaft according to claim 5 wherein the cam body and the ring collar are one piece.

20. The camshaft according to claim 9 wherein the ring collar consists of one axial side having the cam body.

* * * * *